US010232240B2

(12) United States Patent
Zein

(10) Patent No.: US 10,232,240 B2
(45) Date of Patent: Mar. 19, 2019

(54) ARTICLES OF PLAY FOR USE IN THE GAME OF CATCH

(76) Inventor: Rami Zein, Falls Church, VA (US)

( * ) Notice: Subject to any disclaimer, the term of this patent is extended or adjusted under 35 U.S.C. 154(b) by 322 days.

(21) Appl. No.: 14/129,346

(22) PCT Filed: Feb. 24, 2012

(86) PCT No.: PCT/US2012/026568
§ 371 (c)(1),
(2), (4) Date: Feb. 25, 2014

(87) PCT Pub. No.: WO2013/006214
PCT Pub. Date: Jan. 10, 2013

(65) Prior Publication Data

US 2014/0162811 A1 Jun. 12, 2014

Related U.S. Application Data

(60) Provisional application No. 61/457,903, filed on Jul. 1, 2011.

(51) Int. Cl.

| | |
|---|---|
| ***A63B 67/00*** | (2006.01) |
| ***A63B 65/12*** | (2006.01) |
| ***A63B 59/20*** | (2015.01) |

(52) U.S. Cl.
CPC ..... *A63B 67/002* (2013.01); *A63B 59/20* (2015.10); *A63B 65/12* (2013.01); *A63B 65/122* (2013.01); *A63B 2208/12* (2013.01); *A63B 2209/10* (2013.01)

(58) Field of Classification Search
CPC ..... A63B 67/205; A63B 67/00; A63B 67/002; A63B 2208/12; A63B 2209/10; A63B 59/025; A63B 65/12; A63B 65/122
See application file for complete search history.

(56) References Cited

U.S. PATENT DOCUMENTS

| | | | | |
|---|---|---|---|---|
| 2,961,239 A * | 11/1960 | Von Arnhem | ..... | 473/513 |
| 3,052,226 A | 9/1962 | Woll | | |
| 4,443,013 A * | 4/1984 | Burt | ..... | A63B 67/083 473/505 |
| 5,080,374 A | 1/1992 | Yu | | |

(Continued)

FOREIGN PATENT DOCUMENTS

| | | | | |
|---|---|---|---|---|
| CA | 2157693 A1 | 10/1996 | | |
| FR | 836119 A | 1/1939 | | |
| FR | 836119 A * | 1/1939 | ..... | A63B 59/00 |

OTHER PUBLICATIONS http://translationportal.epo.org/emtp/translate?ACTION=description-retrieval&COUNTRY=FR&ENGINE=google&FORMAT=docdb&KIND=A&LOCALE=en_EP&NUMBER=836119&OPS=ops.epo.org%2F3.1&SRCLANG=fr&TRGLANG=en&apikey=TSMqTfrVAvNtryGl8Qlfbozj8DnAGIqJ&PDF=true.*

*Primary Examiner* — Melba Bumgarner
*Assistant Examiner* — Amir Klayman
(74) *Attorney, Agent, or Firm* — Maskell Law PLLC; Benjamin E. Maskell

(57) ABSTRACT

Disclosed herein is a game system that includes a receiving mechanism and a ball. The receiving mechanism frictionally retains the ball therein. The friction is caused by pressure that is applied on opposing points of a secant line about a surface of the ball. The frictional retention is effected by pressure applied by the receiving mechanism on at least two opposing points on the surface of the ball and the contact points of the receiving mechanism are distributed along a common secant around the ball.

9 Claims, 8 Drawing Sheets

(56) References Cited

U.S. PATENT DOCUMENTS

| | | | | |
|---|---|---|---|---|
| 2007/0191154 | A1* | 8/2007 | Genereux | A63B 24/0021 473/524 |
| 2007/0238561 | A1* | 10/2007 | Hu | 473/524 |
| 2011/0053714 | A1 | 3/2011 | Skowronski | |

* cited by examiner

ARTICLES OF PLAY FOR USE IN THE GAME OF CATCH

CROSS-REFERENCE TO RELATED APPLICATIONS

This application is a continuation of International Application No. PCT/US12/26568, filed Feb. 24, 2012, which claims the benefit of U.S. Provisional Application No. 61/457,903, filed Jul. 1, 2011, all of the aforementioned applications are hereby incorporated by reference in their entirety.

FIELD OF THE INVENTION

This disclosure relates to articles of sport and play and, more particularly, to unique articles for playing the game of catch. Said articles are particularly useful for both young children and adult players.

BACKGROUND

The game of catch has been played since antiquity, both as a form of play and, in more recent times, as part of a sport such as lacrosse, etc. As is well known, the game is played by tossing a ball (or any similar article) back and forth between two or more players. The players may have the intention of repetitively passing the ball back and forth, or passing the ball with the intention of a fellow teammate scoring a goal, such as in lacrosse, or the like. At the most simplistic level, the game of catch consists of at least two people, a catcher, and a thrower. The thrower launches the ball by physically throwing the ball with his or her hand toward the catcher. The catcher in turn catches the ball by placing his or her bare hands in the flight path of said ball. As the ball collides with the catcher's hands, the catcher grasps the ball so as to secure it. In a more complicated example, the game of catch can be played with the aid of articles of play, such as lacrosse sticks. In said example, the thrower throws the ball by swinging the lacrosse stick. The catcher in turn catches the ball by placing the head of the lacrosse stick in the flight path of said ball. The catcher then recoils the lacrosse stick as to prohibit the ball from falling out of the lacrosse stick's head when the collision between the head of the lacrosse stick and ball first occurs.

SUMMARY OF THE INVENTION

According to an aspect of an exemplary embodiment, there is provided a catching device for use with an inflatable ball, such as a beach ball. According to aspects of exemplary embodiments, the game of catch is simplified so that it may be easily played by young children and adults. In the game according to an exemplary embodiment, the catching device does not require the catcher to recoil in order for the ball not to fall from the catching device unlike a lacrosse stick, which requires the catcher to recoil. The catching device does not require any other action besides the catcher to intersect the flight path of the ball with the catching device, as to allow the ball to enter a closed loop generally positioned about at the catching device's center. The catching device can secure the ball by friction only. The catching device can double as a throwing device. Once the catcher has completed the catch, the catcher can thus become the thrower. The thrower simply strikes the ball out of the catching device toward another catcher. A first embodiment disclosed herein is a game system that includes a receiving mechanism 4 and a ball. The receiving mechanism 4 frictionally retains the ball therein. The friction is caused by pressure that is applied on opposing points of a secant line about a surface of the ball. The frictional retention is effected by pressure applied by the receiving mechanism 4 on at least two opposing points on the surface of the ball and the contact points of the receiving mechanism 4 are distributed along a common secant around the ball. The frictional retention can also be effected by a hook-and-pile system such as Velcro®. The receiving mechanism 4 can take on various shapes such as a circle, a triangle, a square, a trapezoid, a pentagon, a hexagon, an octagon and a polygon. Closed or open loop receiving mechanisms are acceptable. The receiving mechanism 4 has a handle integrated therein. The receiving mechanism 4 can be made of two components, a stiffening member and a resilient sheath that surrounds, at least partially, the stiffening member. The resilient sheath is not necessarily resilient. It should, however, have a proper coefficient of friction that would allow a ball such as a beach ball to be retained in a hoop that is made of the sheath material. The cross-sections of the stiffening member and the resilient sheath are tubular, although they are not necessarily limited thereto, they can be any closed or semi-closed shape. The cross section of the stiffening member can be rectangular or otherwise cornered to prevent rotation/slippage of the resilient sheath about the stiffening member. Further, the resilient sheath is not required to be resilient; rather, it should have enough friction, tackiness, or adhesive to maintain a ball in a fixed position. The stiffening member extends adjacent to or inside of the resilient sheath. Generally, though not required, the stiffening member extends no more than about six inches into the resilient sheath. The stiffening member can also be configured as a continuous loop that is entirely or almost entirely surrounded by the resilient sheath. Optionally, the receiving member is made up only of the resilient portion, i.e., no stiffening member is used in the receiving mechanism. A handle is thus integrated into the resilient sheath, either made of the same material or secondary material. A further embodiment is a volley system including a catching device. The catching device is made of a through-hole, a frame, a handle and a ball retaining portion. The handle is connected to the frame. The ball retaining portion retains a ball through a combination of pressure and friction. A mechanism for securing the ball to the catching device can be added to the volley system. The volley system can be a hook, a strap, a bracket or a handle. The ball does not need to be secured using a securing mechanism; rather, a wedging friction force can be used such that outside force by a handler is not necessary to secure the ball. The amount of force necessary to remove the ball from the volley system can be as little as a quarter of a pound. A yet further embodiment is a volley system that includes a throwing device component. The throwing device component includes a ball staging portion having a frame, a handle and a ball ejection mechanism, the handle connected to the ball staging portion. The ejection mechanism can include an actuable resilient member, which stores energy to be imparted onto the ball for the ball's release. A trigger can be added to the ejection mechanism to actuate the resilient member. The ball staging portion retains a ball through frictional contact between the ball and the ball staging portion. The ball staging portion can be shaped as a circle, a triangle, a rectangle, a square, a trapezoid, a pentagon, a hexagon, an octagon or a polygon.

DETAILED DESCRIPTION OF THE PREFERRED EMBODIMENTS

Figure 1:
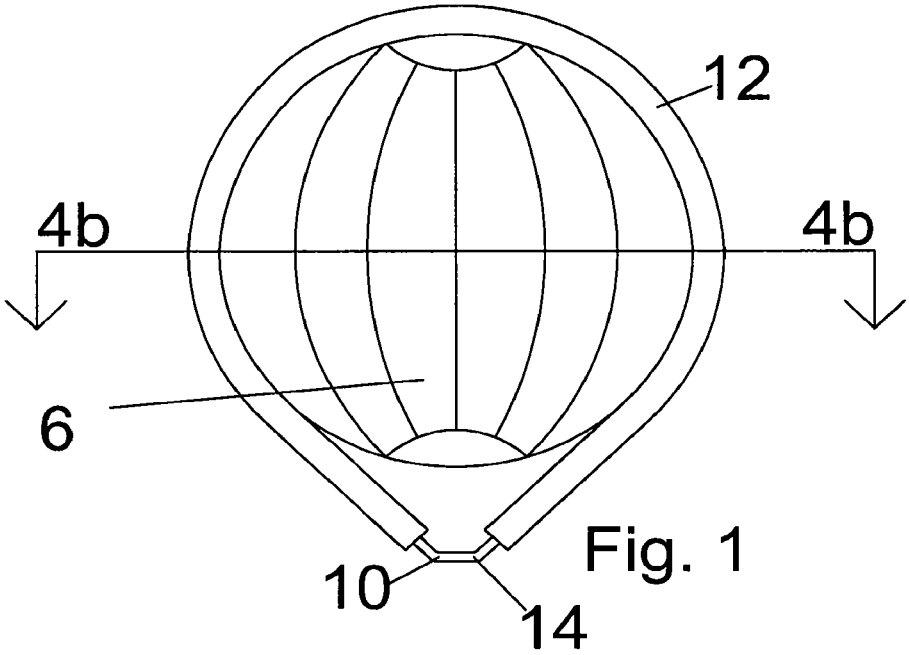
FIG. 1 is a front view of an article of play for use in a game of catch.
Figure 2:
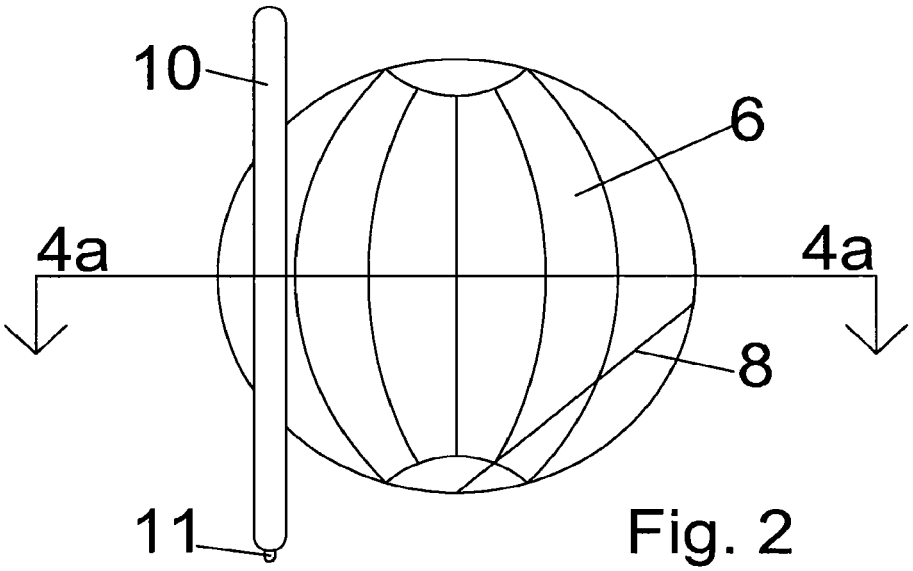
FIG. 2 is a side view of the article of play.
Figure 3A:
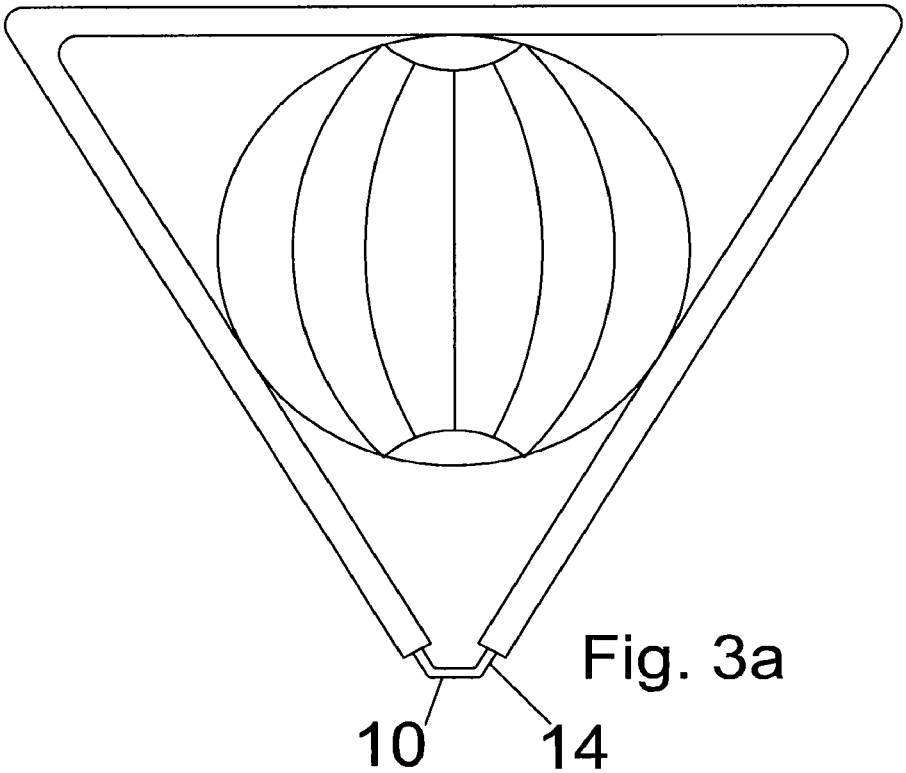
FIGS. 3*a*-3*h* are views of alternate shapes of the article of play.
Figure 3B:
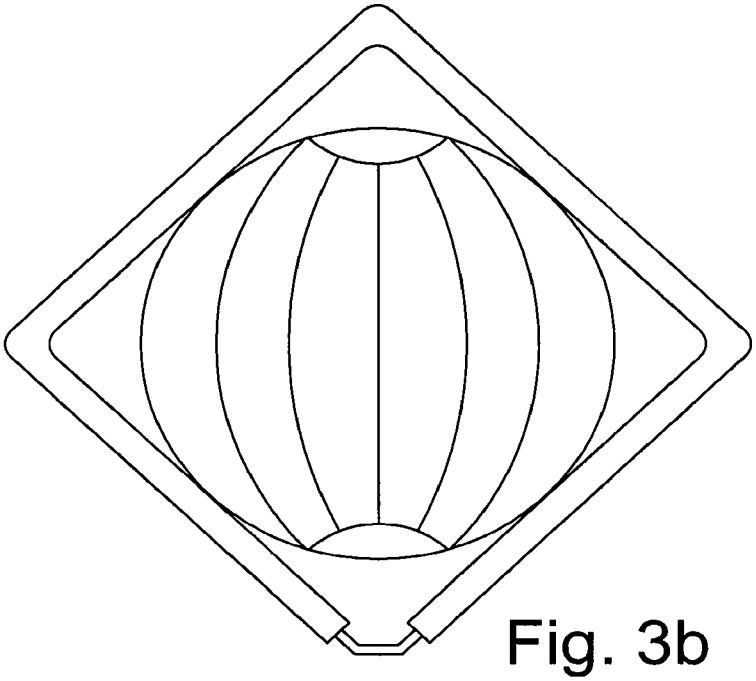
Figure 3C:
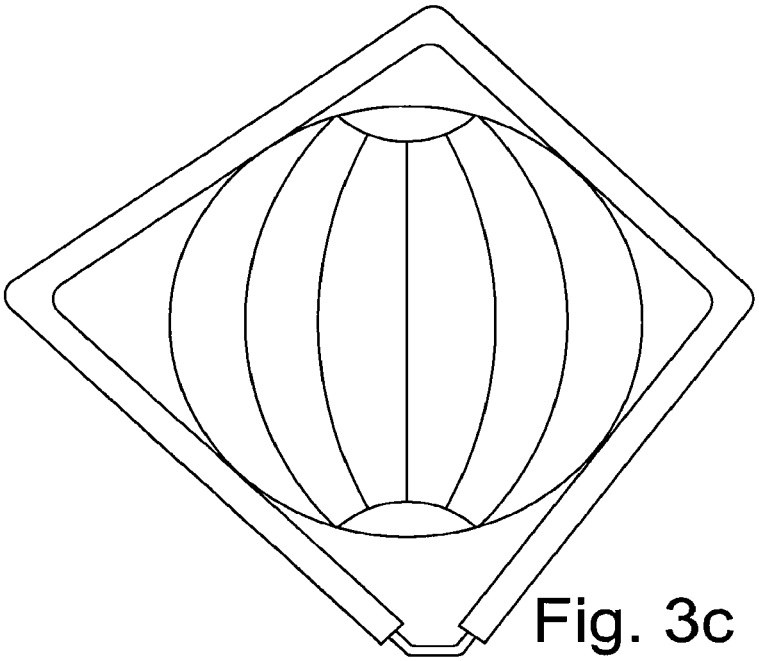
Figure 3D:
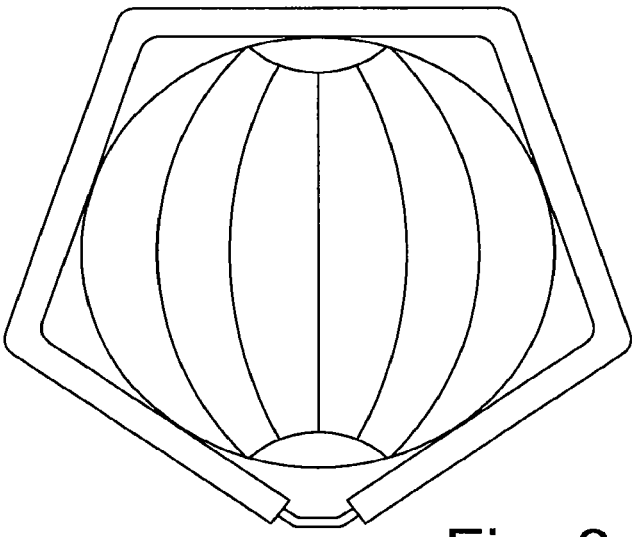
Figure 3E:
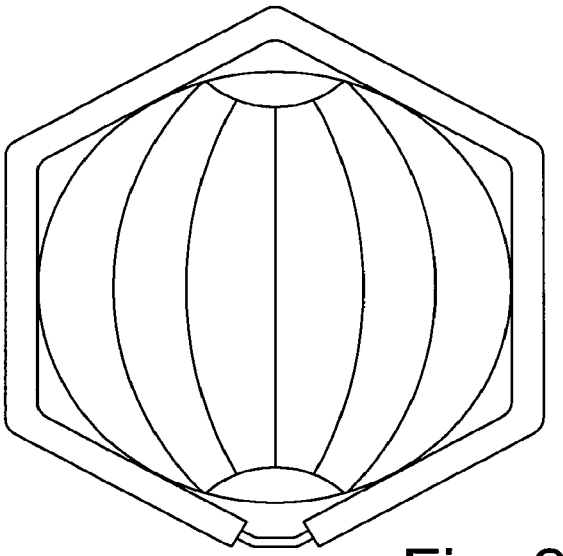
Figure 3F:
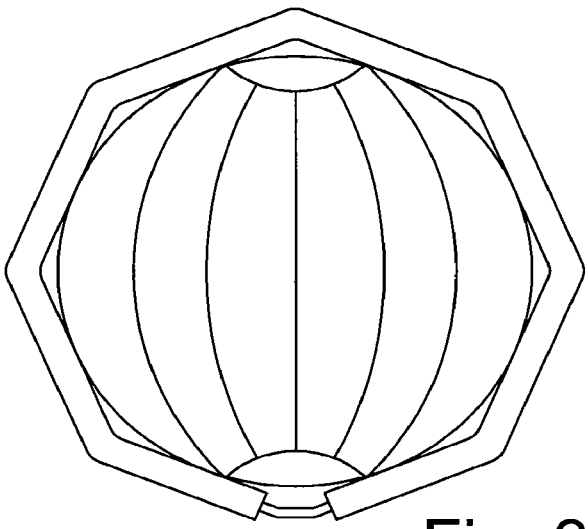
Figure 3G:
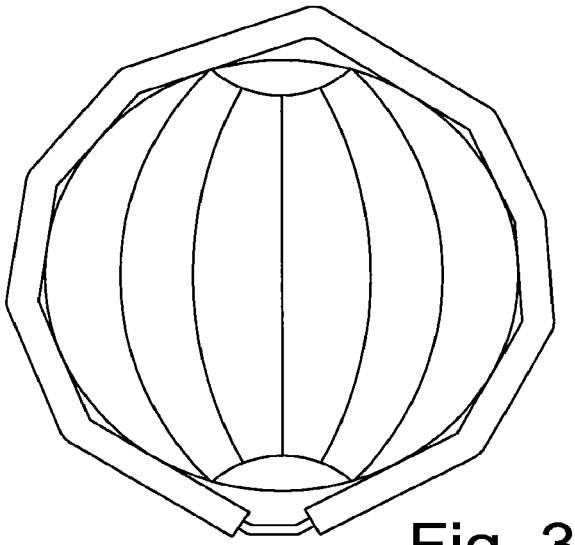
Figure 3H:
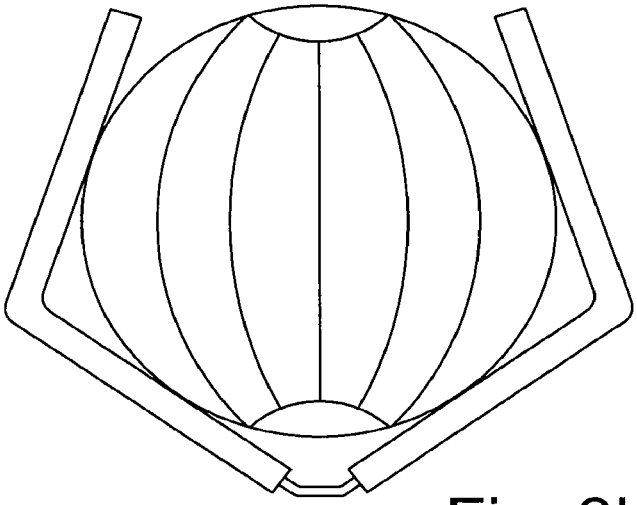
Figure 4A:
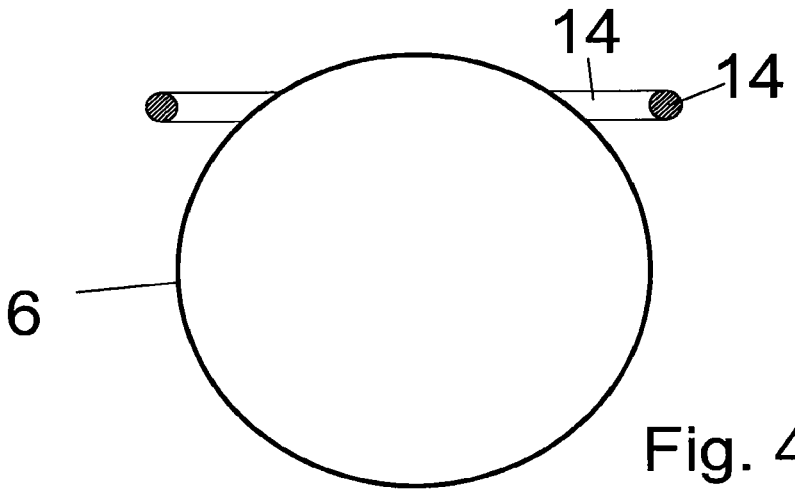
FIGS. 4*a* and 4*b* are cross-sectional views of ball being caught by a catching device.
Figure 4B:
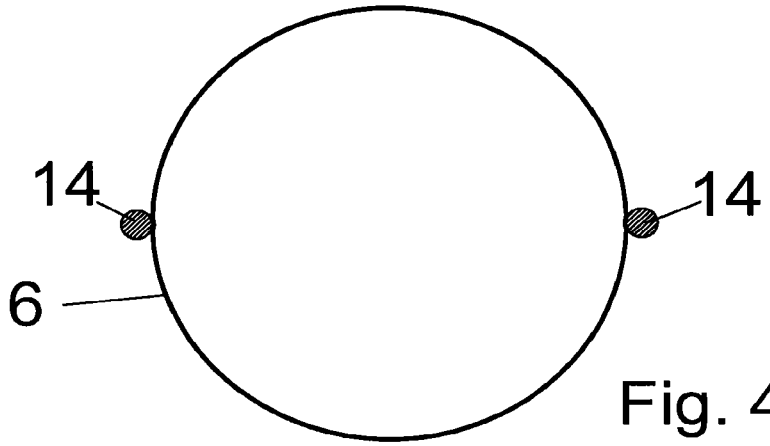
Figure 5:
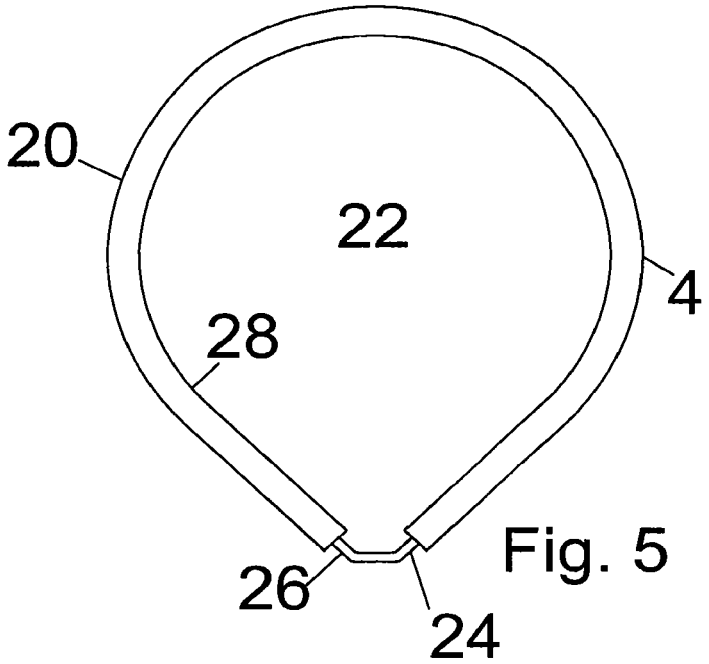
FIG. 5 is a front view of a further embodiment of the article of play.
Figure 6:
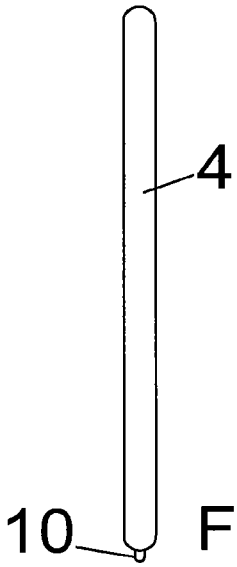
FIG. 6 is a side view of the further embodiment of the article of play.
Figure 7:
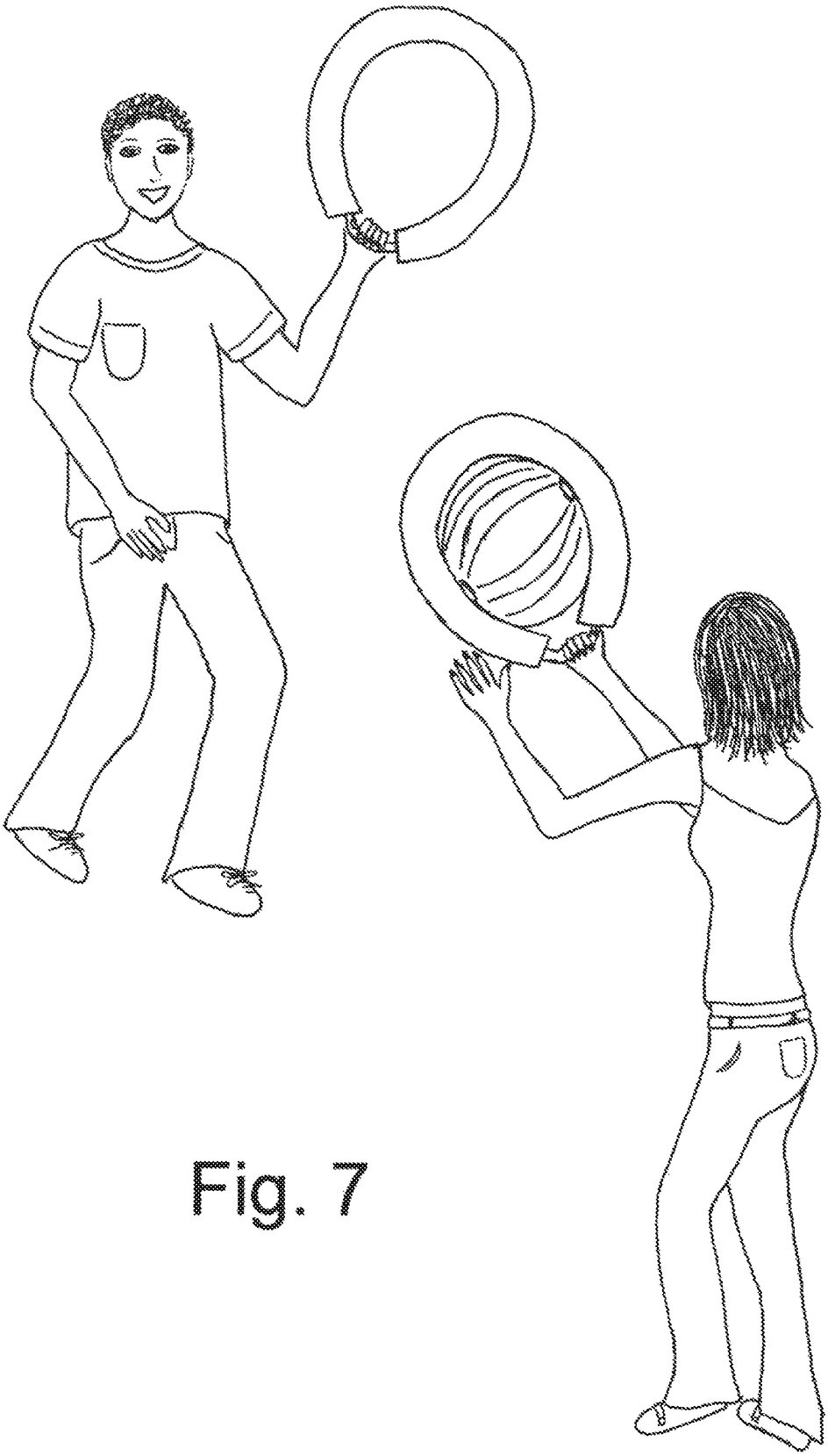
FIG. 7 is a perspective view of a catcher and a thrower, each of whom is utilizing the catching device according to an exemplary embodiment.

Referring now to exemplary embodiments in more detail in FIG. 1 to FIG. 2, there is shown an embodiment of the catching device. A first embodiment disclosed herein is a game system 2 that includes a receiving mechanism 4 and a ball 6. The receiving mechanism 4 frictionally retains the ball 6 therein. The friction is caused by pressure that is applied on opposing points of a secant line 8about a surface of the ball 6. The frictional retention is effected by pressure applied by the receiving mechanism 4 on at least two opposing points on the surface of the ball 6 and the contact points of the receiving mechanism 4 are distributed along a common secant around the ball 6. The frictional retention can also be effected by a hook-and-pile system such as Velcro®. The receiving mechanism 4 can take on various shapes such as a circle, a triangle, a square, a trapezoid, a pentagon, a hexagon, an octagon, a polygon, a y-shape and a v-shape as shown in FIGS. 3*a*-3*h*. Closed or open loop receiving mechanisms are acceptable. The receiving mechanism 4 has a handle 10 integrated therein. The receiving mechanism 4 can be made of two components, a stiffening member 14 and a resilient sheath 12 that surrounds, at least partially, the stiffening member 14. The receiving mechanism 4 is comprised of a pipe, i.e., the stiffening member, and a cylindrical foam i.e., the resilient sheath 12. The foam can be polyethylene and the pipe can be polyvinyl chloride (PVC); preferably, however, the pipe is firm (plastically deformable) polyethylene. Polyethylene is a safe material as it is less brittle than PVC and will bend rather than break thereby avoiding dangerous jagged edges. Although many materials can be substituted for polyethylene foam and polyvinyl chloride, the preferable characteristics of the polyethylene foam are that it is pliable. However, any similarly frictional material can be used in place of polyethylene foam and any similarly stiff material can be used in place of polyvinyl chloride pipe. The preferable characteristic of the pipe is rigidity. The polyvinyl chloride pipe has two functions: the polyvinyl chloride pipe acts as a handle for both the catcher and the thrower to grasp and the polyvinyl chloride pipe connects to both ends of the polyethylene foam to form a closed loop in which a ball may be secured. The cross-sections of the stiffening member 14 and the resilient sheath 12 are tubular, although they are not necessarily limited thereto. The stiffening member 14 extends adjacent to or inside of the resilient sheath 12. Generally, though not required, the stiffening member extends no more than about six inches into the resilient sheath 12. Optionally, the receiving mechanism 4 is made up only of the resilient sheath portion 12, i.e., no stiffening member is used in the receiving mechanism. For such a configuration, it is desirable that the receiving mechanism 4 be firm enough to maintain its shape, e.g., circular, rectangular, triangular, etc. With reference to FIGS. 5 and 6, the receiving mechanism 4 contains a void in its center that is about the same diameter as the outside diameter of the polyvinyl chloride pipe to allow the insertion of the polyvinyl chloride pipe into the polyethylene foam void. The connection is reinforced with polyvinyl pipe adhesive. As shown in FIGS. 5 and 6, a further embodiment is a volley system including a catching device 20. The catching device 20 is made of a through-hole 22, a frame 24, a handle 26 and a ball retaining portion 28. The handle 26 is connected to the frame 24 the ball retaining portion 28 retains a ball through an application of a combination of pressure and friction. In this embodiment, the ball is the size of a beach ball; however, the sizes of the catching device and the ball are not limited to beach ball size. The catching device 20 can be several times larger and several times smaller than a beach ball. The catching device 20 should be scaled so that the diameter of the ball is slightly larger than the closed loop in the center of the catching device. Due to the pliable nature of both the polyethylene foam and the ball, the slightly larger diameter of the ball will ensure a secure fit within the catching device. If the difference of the diameter of the ball and the closed loop formed within the catching device is too great or too small, the ball will not be received properly by the catching device. The diameter of the ball can be slightly corrected by the addition or subtraction of air from within the ball. Alternatively, an inflatable catching device can be employed to secure a ball. The resilient sheath can be equipped with a hermetically sealable compartment. Thus, air can be added or subtracted to the catching device to enable adjustment of the difficulty in catching the ball. The catching device correctly functioning depends on four factors. The first factor is the catcher. The catcher should position the catching device in the flight path of the beach ball. The second factor is the size differential between the diameter of the beach ball and the size of the closed loop formed within the catching device. The difference in size must allow the ball to enter the catching device; and at the same time, cause the friction needed so that the ball becomes secure within the catching device. The third factor is a function of the pliable properties of the materials used to produce the catching device as well as the ball. The pliable properties of the materials allows for the ball, which is greater in diameter than the closed loop of the catching device to snugly fit within the catching device. The catching device secures the ball by way of the tangential friction that occurs as the beach ball attempts to pass through the catching device. A mechanism for securing the ball to the catching device can be added to the volley system. The volley system can be a hook, a strap, a bracket or a handle. The ball does not need to be secured using a securing mechanism; rather, a wedging friction force can be used such that outside force by a handler is not necessary. The amount of force necessary to remove the ball from the volley system (can be) as little as a quarter of a pound. A yet further embodiment is a volley system that includes a throwing device component. The throwing device component includes a ball staging portion having a frame, a handle and a ball ejection mechanism, the handle is connected to the ball staging portion. The ejection mechanism includes an actuable resilient member, which stores energy to be imparted onto the ball for the ball's release. A trigger can be added to the ejection mechanism to actuate the resilient member. The ball staging portion retains a ball through frictional contact between the ball and the ball staging portion. The ball staging portion can be shaped as a circle, a triangle, a square, a trapezoid, a pentagon, a hexagon, an octagon or a polygon. Referring now to an exemplary embodiment in more detail in FIGS. 4*a* and 4*b*, there is shown a traditional ball in flight as it approaches the catching device. The inside edge of the polyethylene foam first acts like a funnel on the traditional ball as shown in FIGS. 4*a* and 4*b*. The funnel action corrects slight misalignments between the catching device and the traditional ball. Referring again to an exemplary embodiment in more detail in FIG. 1 and FIG. 2, there is shown a catching device containing the traditional ball after it has been caught and secured. The inside edge of the polyethylene foam secures the traditional ball as shown in FIG. 2 and FIG. 4*b*, which is wedged in between the polyethylene foam. Referring now to an exemplary embodiment in more detail, in FIG. 7, there is shown a perspective view of a catcher and a thrower, each of whom is utilizing the catching device according to an exemplary embodiment. The catcher can quickly become the thrower once the traditional ball is caught by the catching device by simply striking the ball with his or her hand out of the catching device toward the next catcher. This is possible due to the lack of a net or backing of any kind which is found in traditional catching devices and articles of play, such as a lacrosse stick, tennis racket, baseball glove, etc. In addition to playing one on one catch, the catching device can be used as the primary article of play during an organized sport, similar to lacrosse. The catching devices can be distributed to a large number of people who make up opposing teams. In this instance, the catching device can be used to block the ball from the goal, to knock a ball loose from an opposing players catching device, or to intercept an attempted pass between two opposing players. While the foregoing written description of exemplary embodiments enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

What is claimed is:

1. A game system comprising:

a ball;

a receiving mechanism;

a fixed-size aperture of the receiving mechanism;

a resilient foam sheath partially surrounding the receiving mechanism;

a first portion of the resilient foam sheath configured to frictionally retain the ball;

a second portion of the resilient foam sheath configured to frictionally retain the ball;

a handle formed in an edge of the aperture;

a first end of the handle connected to the receiving mechanism; and a second end of the handle opposite the first end and connected to the receiving mechanism.

2. The game system of claim 1 wherein the fixed-size aperture is not adjustable.

3. The game system of claim 1 wherein the receiving mechanism is a closed loop.

4. The game system of claim 1 wherein the receiving mechanism further comprises:

a stiffening member.

5. The game system of claim 1 wherein the resilient foam sheath is formed from polyethylene foam.

6. The game system of claim 1 wherein the ball further comprises diameter;

the aperture further comprises a first dimension measured between opposing sides of the aperture; and wherein the diameter is larger than the first dimension.

7. The game system of claim 1 wherein the ball is an inflatable ball and the size of the ball is adjustable by varying a level of inflation of the ball.

8. A game system comprising:

an inflatable ball;

a receiving mechanism configured to frictionally retain the ball, a resilient foam sheath of the receiving mechanism;

a fixed-size aperture of the receiving mechanism;

a handle;

a first distal end of the handle connected to the receiving mechanism;

a second distal end of the handle opposite the first distal end and connected to the receiving mechanism;

wherein the handle is an edge of the aperture; and wherein the inflatable ball, when inflated, is larger than the aperture.

9. The game system of claim 8 wherein the fixed-size aperture is not adjustable.

* * * * *